United States Patent [19]

Weintz

[11] Patent Number: 4,459,949

[45] Date of Patent: Jul. 17, 1984

[54] LIQUID METAL COOLED INTERNAL COMBUSTION ENGINE VALVES WITH GETTER

[75] Inventor: Richard Weintz, Hüfingen, Fed. Rep. of Germany

[73] Assignee: Teves-Thompson GmbH, Hanover, Fed. Rep. of Germany

[21] Appl. No.: 411,920

[22] Filed: Aug. 26, 1982

[30] Foreign Application Priority Data

Feb. 12, 1982 [DE] Fed. Rep. of Germany ..... 3204986

[51] Int. Cl.[3] ..... F01L 3/14

[52] U.S. Cl. ..... 123/188 GC; 123/188 A; 123/41.34

[58] Field of Search ..... 123/41.34, 41.16, 188 A, 123/188 AA, 41.41, 198 E, 198 A; 417/48–51; 252/181.4, 181.7

[56] References Cited

U.S. PATENT DOCUMENTS

| | | | |
|---|---|---|---|
| 2,369,063 | 7/1942 | McDill | 123/41.16 |
| 2,548,092 | 4/1951 | Bartlett et al. | 123/188 AA |
| 3,243,280 | 3/1966 | Bohlmann | 75/66 |
| 3,578,834 | 5/1971 | Porta et al. | 252/181.4 |
| 4,312,669 | 1/1982 | Boffito | 75/177 |

OTHER PUBLICATIONS

AEC Monograph, "Alkali Metal Handling and Systems", Operating Techniques, (1967).

"Sodium Purification with Hot Precipitation", Borgsledt et al., Atomwirtschaft, Sep./Oct., 1972.

vol. 110, No. 9, Journal of the Electrochemical Society, Sep., 1963, pp. 960–964.

*Primary Examiner*—Ira S. Lazarus
*Assistant Examiner*—R. S. Bailey
*Attorney, Agent, or Firm*—Yount & Tarolli

[57] ABSTRACT

A getter selected from the group consisting of zirconium, hafnium, yttrium, and mixtures thereof is used as an additive for metal coolants, e.g., sodium, potassium and sodium-potassium alloys, in metal cooled internal combustion engine valves.

18 Claims, 1 Drawing Figure

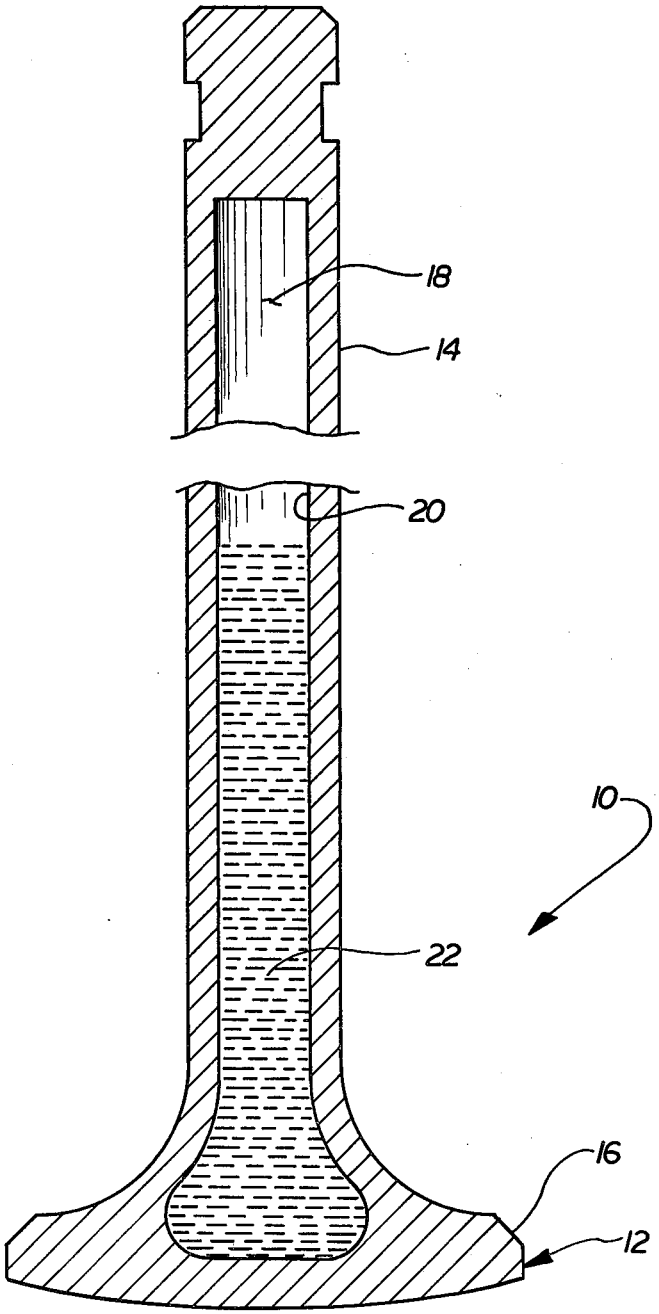
18
14
20
10
22
16
12

LIQUID METAL COOLED INTERNAL COMBUSTION ENGINE VALVES WITH GETTER

FIELD OF THE INVENTION

This invention concerns a liquid metal cooled internal combustion engine valve with a getter, a method of cooling such a valve, and an internal combustion engine having such a valve.

BACKGROUND OF THE INVENTION

Internal combustion engine valves, especially exhaust valves, are sometimes cooled by special measures in the areas of very high heat stress, so that conventional valve materials can be used within the maximum operation temperatures of the engine. The present invention concerns liquid metal cooled internal combustion engine valves which have a hollow, closed chamber therein partially filled with a metal coolant, at least a portion of which is fluid at normal engine operating temperatures, to improve heat transfer from the valve head to the valve stem.

Sodium, because of its high heat conductivity, is frequently used as the metal coolant in the hollow closed cooling chamber within such valves. The coolant, such as sodium, is at least partially fluid at the operating temperatures of the valves. The reciprocating motion of the valve, in opening and closing, leads to a thorough mixing of the coolant and thus to removal of heat from the hot valve head to the cooler valve stem. Other metallic coolants are known for use in such valves, such as potassium, and sodium-potassium alloys.

However, both sodium and potassium can react with contaminants to reduce the intended cooling. For example, sodium and potassium, in the presence of a humid atmosphere, form oxides, carbonates, and hydroxides, the latter being very hygroscopic. Considerable care has to be taken to preclude the introduction of contaminants into the closed cooling chamber in the valve while placing the metal coolant therein, and regardless of the practical precautions taken, contaminants can still be introduced into the closed cooling chamber.

If water as a contaminant comes into contact with the sodium coolant, the water reacts with the sodium to release sodium hydroxide and free hydrogen according to the following equation:

$$H_2O + Na = NaOH + \tfrac{1}{2}H_2$$

Above about 435° C., sodium hydroxide decomposes in the presence of sodium by the following equation:

$$NaOH + 2Na = Na_2O + NaH$$

Sodium hydride (NaH) has a high vapor or decomposition pressure, so that together with the hydrogen formed by the decomposition of water, a considerable vapor pressure can result in the hollow cooling space, which leads to a dangerous static pressure on the valve. The vapor pressure is additionally increased when even slight amounts of oily substances are decomposed into carbon and hydrogen at high temperatures.

The resulting sodium oxide ($Na_2O$) from the last equation noted above causes the wall of the closed cooling chamber to become oxidized because a great many of the materials used for the valves contain alloying elements which have a greater affinity for oxygen than sodium. These oxides formed with the valve alloying elements penetrate along the paths of the grain boundaries, thus forming notches which, in turn, may permit fatigue cracks to propagate. Such fatigue cracks are exacerbated by the possible high internal pressure caused by the presence of hydrogen. These oxide layers also increase resistance to heat conductivity within the valve body itself, and they also reduce heat transfer between the coolant and the valve body.

If the internal vapor pressure within the closed cooling chamber is permitted to increase, the internal mixing of the coolant, as a result of the reciprocating movement of the valve, is reduced and the cooling impaired.

Very small amounts of contaminants of water, hydrocarbons, sodium hydroxide, sodium oxide, nitrogen, oxygen and water vapor, in the milligram range, can create the foregoing problems. The increased internal vapor pressure and oxide formation can result in premature failure of the valves in the motor.

To alleviate the foregoing problems, it was proposed to add calcium, calcium carbide or calcium hydride because they have a greater affinity for oxygen, nitrogen, carbon and hydrogen than sodium, potassium and the valve alloying materials. See German Patent Application No. P 30 15 201.3, published Oct. 22, 1981. However, the disadvantage with calcium is that the calcium reaction products themselves, especially calcium oxide, can form deposits on the interior surfaces of the hollow cooling chamber in the valve which, as noted previously, impairs cooling.

SUMMARY OF INVENTION

The present invention uses an additive in the metal coolant in an internal combustion engine valve to reduce the foregoing problems of high internal gas pressure and oxide formation. The getters or scavengers of the present invention which are added to the metal coolant are selected from the group consisting of zirconium, hafnium, yttrium and mixtures of the foregoing. The mixtures preferably contain about 50% or more zirconium by weight of the additive, e.g., about 50% by weight zirconium and about 50% by weight yttrium. (Hereinafter, unless otherwise indicated, all percentages are based on weight.) The metal coolant is preferably potassium, sodium, or potassium-sodium alloys.

The getters can be advantageously added to the metal coolant in the form of a tablet. Depending on the extent of contaminants in the metal coolant, the getter of the present invention is generally added from about 1% to about 20% based on the total weight of metal coolant including the weight of the additives. More preferably, the getter is present from about 2% to 10%.

As a result of the addition of the foregoing getters, the contaminants such as oxygen, hydrogen, nitrogen and carbon are reacted, combined or otherwise bound such that no layer forms on the walls of the cooling chamber which would otherwise inhibit heat transfer. In addition, the getters reduce the formation of gaseous materials which increase the internal vapor pressure. The addition of the getters thereby improves the conditions for heat transfer and cooling for which the metal cooled valve was designed. Reducing the internal vapor pressure permits the reciprocating action of the valve during engine operation to improve mixing of the cooler and hotter portions of the metal coolant. It is also important to note that the nitrogen component in the hollow space in the cooling chamber is converted into a compound with a low vapor pressure so that the vapor pressure in the hollow space of the valve is reduced to the vapor pressure of the coolant employed.

BRIEF DESCRIPTION OF FIGURE

The FIGURE is a sectional view of an internal combustion engine valve having a metal coolant therein.

DESCRIPTION OF PREFERRED EMBODIMENT

The FIGURE shows a cross-sectional view of a metal cooled internal combustion engine valve 10 having a head 12 and a stem 14. The valve head 12 has a contact surface 16 which is beveled for gas-seating engagement with a valve seat surface. Internally, the valve 10 has a hollow, closed cooling chamber 18 with wall surfaces 20 in both the stem 14 and the head 12. Located within the hollow cooling chamber 18 is a metal coolant 22, shown in the FIGURE in a static, liquid state as it would be shortly after an engine ceased operation.

During operation of an internal combustion engine, the metal coolant 22 in the hollow cooling chamber 18 is changed from a solid to a liquid state as a result of the increased operating temperature. Once in a fluid condition, the metal coolant is thoroughly mixed by the reciprocating of the valve during its operation. Reciprocating the internal combustion engine valve not only mixes the cooler and hotter portions of the coolant, but also forces the coolant to move up and down the valve stem to transfer heat from the valve head to the cooler valve stem. Generally, the valve head temperature does not exceed about 900° C. to about 950° C.

The most frequently employed metal coolants for metal cooled internal combustion engine valves are sodium, potassium and sodium-potassium alloys. Of those, sodium is the most commonly used. Preferred sodium-potassium alloys are those containing between about 40% to about 90% by weight potassium with the balance being sodium. Sodium and potassium form a eutectic at about 78% by weight potassium and 22% by weight sodium with a melting point of about minus 11° C. The low melting point of this eutectic is advantageous for facilitating the filling of valves at low temperatures, e.g., room temperature.

The getters or scavengers of the present invention are selected from the group consisting of zirconium, hafnium, yttrium and mixtures of the foregoing. Preferably the mixtures are those employing at least about 50% zirconium based on the weight of the additives, e.g., 50% zirconium and 50% hafnium as the getter mixture. The getter preferably constitutes about 1% to about 20% of the total weight of the metal coolant including the getter; most preferably the getter constitutes about 2% to about 10%.

Zirconium is preferably used for valves made of iron based alloys and materials. Yttrium is preferably used for valves made of nickel based materials to prevent formation of intermetallic compounds between nickel and zirconium which possess low melting points. In order to remove hydrogen from the cooling chambers of nickel based valves, an adequate amount of zirconium should be added to the yttrium, generally in the range of about 10% by weight of the yttrium content. Yttrium is also especially advantageous when the valve is made of an aluminum alloyed material, such as Niomonic 80A.

Depending on the valve base material, the getters of the present invention must provide sufficient free energies of formation and also not form compounds which would establish any heat transfer barrier on the valve wall. Zirconium is especially advantageous because of its high degree of affinity for hydrogen. The hydrogen partial pressure in the hollow cooling space of the valve is reduced because of the formation of zirconium hydride which has a very much lower partial pressure than sodium hydride.

The quantity of getters employed in the present invention depends primarily on the extent of contamination with oxygen, nitrogen, hydrogen and carbon. Particularly important is the extent of contamination of oxygen which would form oxide layers on the inside surfaces of the hollow cooling chamber. The possible ranges of contamination by oxygen, nitrogen, hydrogen and carbon must be considered. The getters react preferentially at their surfaces with the contaminants leaving a portion of the interior of the getter unreactive. This requires a surplus amount of additive or getter as compared to the stoichiometric amount. Preferably, about two to about five times the theoretical stoichiometric is required. Under manufacturing conditions involving cleaning the interior portion of the valve and the handling of the sodium in an unprotected atmosphere, about 2% by weight of getter has been found to be sufficient to chemically bind approximately 0.25% by weight of oxygen and the nitrogen content entrained in the metal coolant. Generally, this means that about 0.02 grams of getter will be required for a passenger car exhaust valve. Since the hollow cooling space is only filled approximately two-thirds with the coolant, the remaining hollow space in the cooling chamber is filled with air containing about 79% by volume of nitrogen, which will have to be absorbed in order to evacuate the cavity to allow free movement of the metal coolant during engine operation. Furthermore, residues of oil which will decompose into hydrogen and carbon require sufficient amounts of getter in order to reduce the partial pressure inside the valve to that of the metal coolant.

The metal cooled valves are manufactured by placing the metal coolant as a solid or liquid into the interior cooling chamber of the valve before sealing. For example, sodium can be extruded in a hydraulic press to very small sticks that fit into the hollow portion of the valve stem. The getter can then be added as a separate element, generally a solid, and preferably in the form of a slug or tablet. If the valve is filled with a coolant in a protected atmosphere, less getter will be required, but for ease of manufacture the valve can be filled with the coolant in normal atmospheric conditions so long as the conditions are taken into account in assessing the amount of getter to be employed.

Experiments with the present invention have shown, surprisingly, that the interior surfaces of the metal cooling chamber of an internal combustion engine valve, even after very long exposure times at normal operating temperatures of exhaust valves, remain completely bare, e.g., bright metal. This apparently can be ascribed to the fact that the getters of the present invention deoxidize, dehydrate and denitrate the metal coolant without resulting in reaction products that have any interfering influence on the cooling function of the metal coolant. The getters of the present invention form compounds which are insoluble in the metal coolant, and the getters form solid oxides, nitrides, hydrides and carbides which possess high free energies of formation.

EXAMPLES

Hollow internal combustion engine valves were filled with the following compositions:

| Example | Getter | Coolant |
|---|---|---|
| 1 | 10% Zr | Bal. Na |
| 2 | 5% Zr | Bal. Na |
| 3 | 2% Zr | Bal. Na |

The valves were then subjected to normal service temperatures and then cut in half longitudinally along the valve stem and base. A visual inspection showed that the getter prevented formation of a heat-insulating coating caused by scales or oxides which impedes heat transfer.

What is claimed is:

1. In an internal combustion engine valve having a head, a valve stem and a sealed cooling chamber therein containing a metal coolant, the improvement wherein said metal coolant contains a getter selected from the group consisting of zirconium, hafnium, yttrium and mixtures of the foregoing adapted to permit said coolant to move freely in the sealed cooling chamber and to reduce any increased internal vapor pressure and deposits on the cooling chamber walls resulting from contaminants, said getter adapted to interact with contaminants trapped in said sealed cooling chamber to retain said contaminants in said metal coolant without creating a heat transfer barrier on said cooling chamber walls.

2. A valve as claimed in claim 1 wherein said getter is present from about 1% to about 20%.

3. A valve as claimed in claim 2 wherein said getter is present from about 2% to about 10%.

4. A valve as claimed in claim 1 wherein said metal coolant is selected from the group consisting of sodium, potassium, and sodium-potassium alloys.

5. A valve as claimed in claim 1 wherein the getter mixtures are those containing at least about 50% zirconium.

6. A valve as claimed in claim 1 wherein said metal coolant comprises from about 1% to about 20% by weight of zirconium and the balance being sodium.

7. In a method of cooling a hot, reciprocating internal combustion engine valve having a head, a valve stem and a sealed cooling chamber therein containing a metal coolant, the improvement comprising providing said metal coolant with a getter selected from the group consisting of zirconium, hafnium, yttrium and mixtures of the foregoing, permitting said getter to combine with contaminants to reduce any increased internal vapor pressure resulting from contaminants and to reduce deposits upon the walls of said sealed cooling chamber, and permitting said coolant to move freely in the sealed cooling chamber during reciprocation, said getter interacting with contaminants trapped in said sealed cooling chamber to retain said contaminants in said metal coolant without creating a heat transfer barrier on said cooling chamber walls.

8. A method as claimed in claim 7 wherein said getter is present from about 1% to about 20%.

9. A method as claimed in claim 8 wherein said getter is present from about 2% to about 10%.

10. A method as claimed in claim 7 wherein said metal coolant is selected from the group consisting of sodium, potassium, and sodium-potassium alloys.

11. A method as claimed in claim 7 wherein the getter mixtures are those containing at least about 50% zirconium.

12. A method as claimed in claim 7 wherein said metal coolant comprises from about 1% to about 20% by weight of zirconium and the balance being sodium.

13. In an internal combustion engine having a reciprocating internal combustion engine valve having a head, a valve stem and a sealed cooling chamber therein containing a metal coolant, the improvement wherein said metal coolant contains a getter selected from the group consisting of zirconium, hafnium, yttrium and mixtures of the foregoing adapted to permit said coolant to move freely in the sealed cooling chamber and to reduce any increased internal vapor pressure and deposits on the cooling chamber walls resulting from contaminants, said getter adapted to interact with contaminants trapped in said sealed cooling chamber to retain said contaminants in said metal coolant without creating a heat transfer barrier on said cooling chamber walls.

14. An engine as claimed in claim 13 wherein said getter is present from about 1% to about 20%.

15. An engine as claimed in claim 14 wherein said getter is present from about 2% to about 10%.

16. An engine as claimed in claim 13 wherein said metal coolant is selected from the group consisting of sodium, potassium, and sodium-potassium alloys.

17. An engine as claimed in claim 13 wherein said getter mixtures contained at least about 50% zirconium.

18. An engine as claimed in claim 13 wherein said metal coolant comprises from about 1% to about 20% by weight of zirconium and the balance being sodium.

* * * * *